United States Patent [19]

Wataya et al.

[11] Patent Number: 5,025,380

[45] Date of Patent: Jun. 18, 1991

[54] METHOD AND DEVICE FOR CONTROLLING THE OPERATION OF AN ENGINE FOR A VEHICLE

[75] Inventors: Seiji Wataya, Himeji; Shoichi Washino, Amagasaki, both of Japan

[73] Assignee: Mitsubishi Denki Kabushiki Kaisha, Japan

[21] Appl. No.: 265,809

[22] PCT Filed: Feb. 10, 1988

[86] PCT No.: PCT/JP88/00132

§ 371 Date: Oct. 11, 1988

§ 102(e) Date: Oct. 11, 1988

[87] PCT Pub. No.: WO88/06234

PCT Pub. Date: Aug. 25, 1988

[30] Foreign Application Priority Data

Feb. 12, 1987 [JP] Japan ..... 62-30018

[51] Int. Cl.[5] ..... F02D 41/30

[52] U.S. Cl. ..... 364/431.05; 123/478; 123/492; 123/361; 364/431.07

[58] Field of Search ..... 364/431.05, 431.07; 123/492, 489, 478, 361

[56] References Cited

U.S. PATENT DOCUMENTS

| | | | |
|---|---|---|---|
| 3,996,910 | 12/1976 | Noguchi et al. | 123/449 |
| 4,040,405 | 8/1977 | Tanaka et al. | 123/450 |
| 4,244,341 | 1/1981 | Noguchi et al. | 123/449 |
| 4,440,140 | 4/1984 | Kawagoe et al. | 123/571 |
| 4,481,928 | 11/1984 | Takimoto et al. | 123/492 |
| 4,640,243 | 2/1987 | Abo et al. | 123/399 |
| 4,706,634 | 11/1987 | Nishikawa et al. | 123/492 |
| 4,707,792 | 11/1987 | Naitou | 364/431.07 |
| 4,724,818 | 2/1988 | Kobayashi | 123/585 |
| 4,768,483 | 9/1988 | Asayama | 123/399 |
| 4,870,935 | 10/1989 | Araki | 123/417 |

FOREIGN PATENT DOCUMENTS

| | | |
|---|---|---|
| 142856 | 5/1985 | European Pat. Off. . |
| 51-38235 | 11/1976 | Japan . |
| 58-25853 | 5/1983 | Japan . |

*Primary Examiner*—Parshotam S. Lall
*Assistant Examiner*—V. N. Trans
*Attorney, Agent, or Firm*—Leydig, Voit & Mayer

[57] ABSTRACT

A method and device for controlling an engine mounted on a vehicle substantially suppresses pitching or surging of the body of the vehicle during acceleration even when the driver abruptly depresses an accelerator pedal, thereby markedly improving riding comfort. A valve such as a throttle valve in an engine intake passage is operatively associated with an accelerator pedal such that the opening degree of the valve is changed by operation of the accelerator pedal to control at least one of the amount of intake air and the amount of fuel supplied to the engine. The valve is controlled by a control unit based on the output signals of an accelerator pedal sensor, a load condition sensor, and an engine rotation sensor such that when the accelerator pedal is operated to rapidly increase the opening degree of the valve, the valve is gradually moved to be at a prescribed degree of opening which is set based on at least one of the sensed amount of accelerator pedal operation, the sensed engine load condition, and the sensed rotational speed of the engine.

23 Claims, 5 Drawing Sheets

METHOD AND DEVICE FOR CONTROLLING THE OPERATION OF AN ENGINE FOR A VEHICLE

TECHNICAL FIELD

The present invention relates to a method and a device for controlling the operation of an engine mounted on a vehicle, and more particularly to an engine control method and device in which the power output of an engine particularly during acceleration is controlled to gradually increase so as to suppress pitching or surging of the vehicle for improved riding comfort.

BACKGROUND ART

A conventional engine control device employs a throttle actuator for generating to operate a throttle valve through an electrical signal for controlling the amount of intake air sucked into a vehicular engine. Specifically, the pressure of intake air sucked into the engine is sensed by a pressure sensor, and the width of pulses for driving a fuel injector disposed in an intake passage or manifold is controlled in accordance with the pressure value thus sensed so that the injector is driven every one or two engine revolutions in synchronization with the output signal of an engine rotation sensor which picks up the number of revolutions per minute of the engine. In this manner, the pulse width for the fuel injector is determined to match the intake air pressure so that a desired amount of fuel is supplied to the engine. Such control of fuel supply to the engine has been widely used as a speed-density type control and hence a further detailed description thereof will be unnecessary.

The amount of intake air sucked into an engine is controlled by a throttle valve which is disposed in the intake passage and which is in general mechanically opened and closed by a driver through a cable connected between the throttle valve and an accelerator pedal. Recently, however, it was proposed in Japanese Patent Application Laid-Open No. 61-126346 that, instead of directly connecting a throttle valve with an accelerator pedal through a cable, the throttle valve be electrically actuated by an electric actuator, and a portion of such an engine control device has been reduced to practice.

The conventional engine control device described above operates as shown in the flow chart of FIG. 1. Specifically, in Step 10, the output of the accelerator pedal sensor representative of the amount of operation $\alpha$ of an accelerator pedal imparted by the driver of a vehicle is read out, and in Step 11, the number Ne of revolutions per minute of the engine (hereinafter abbreviated as RPM) sensed by the engine rotation sensor and the pressure Pb of intake air are read out. Then, in Step 12, a target degree $\theta$ of opening of the throttle valve is calculated based on at least one of $\alpha$, Ne and Pb thus read out. In general, the target degree $\theta$ of throttle opening corresponds basically to the amount of accelerator pedal operation o modified or corrected, as necessary, by engine RPM Ne and intake air pressure Pb. For example, in a range in which the engine RPM Ne is low, the rate of change in the amount of intake air greatly changes with slight changes in the throttle opening degree. Hence it is rather difficult for the driver to precisely control the amount of intake air to be sucked into the engine by adjusting the amount of operation or depression of the accelerator pedal. To cope with this, it is proposed that in the low RPM range, the rate of change in the opening degree of the throttle valve be made smaller with respect to changes in the amount of accelerator pedal operation $\alpha$. On the other hand, it has also been considered that a target value of engine RPM Ne or vehicle speed be set by the operation amount $\alpha$ of the accelerator pedal so that the actual throttle opening is controlled by feedback based on the difference between the target value and the, sensed value of engine RPM Ne or vehicle speed. Furthermore, since the intake pressure Pb is a physical quantity which corresponds to the output torque of the engine, it is possible to improve driving comfort by properly adjusting the throttle opening based on the difference between a sensed actual value of intake pressure and a target value which is preset based on the operation amount $\alpha$ of the accelerator pedal. Accordingly, in Step 13, the throttle actuator is driven by an instruction of the control unit to control the throttle valve in such a manner that the actual throttle opening is made to be the target value $\theta$. In this case, the throttle actuator may be a pulse-driven open-loop control type actuator such as a stepping motor or a position-feedback control type actuator such as a DC motor.

FIG. 2 illustrates a timing chart of the conventional engine control device described above. From this chart, it will be seen that the throttle opening rapidly increases as the amount $\alpha$ of accelerator pedal operation or depression rapidly increases.

With the above-described conventional engine control device, when the operation amount of the accelerator pedal increases swiftly, the output torque of the engine increases sharply so that jerk or change in rate of acceleration of the vehicle in which such an engine is installed becomes greater. Accordingly, the vehicle can have excellent acceleration performance, but the riding comfort thereof is impaired. This is because reactive force, which develops upon rapid acceleration of the vehicle and is transmitted through the engine mounts to the vehicle body due to the general construction of the vehicle, causes the vehicle body to vibrate and at the same time pitching or surging thereof will be induced through the suspension system of the vehicle. In particular, the greater the jerk of the vehicle, the greater discomfort or uneasiness the driver feels.

DISCLOSURE OF THE INVENTION

The present invention is intended to obviate the above-mentioned problems of the prior art, and has for its object the provision of an engine control method and device for a vehicle in which pitching or surging of the body of a vehicle during acceleration is substantially alleviated or suppressed even when the operator abruptly operates an accelerator pedal, thereby markedly improving riding comfort.

In order to achieve the above object, according to one aspect of the present invention, there is provided an engine control method for a vehicle in which a valve means in an engine intake passage is operatively associated with an accelerator pedal such that the opening degree of the valve means is changed by operation of the accelerator pedal to control at least one of the amount of intake air and the amount of fuel supplied to an engine, the method comprising the steps of:

sensing the amount of operation of the accelerator pedal imparted by a driver of the vehicle;

sensing the load condition of an engine;

sensing the number of revolutions per minute of the engine; and controlling the valve means in such a manner that, when the accelerator pedal is operated to abruptly increase the opening degree of the valve means, the valve means is gradually moved to a prescribed degree of opening which is set based on at least one of the sensed amount of accelerator pedal operation, the sensed engine load condition, and the sensed number of revolutions per minute of the engine.

According to another aspect of the present invention, there is provided an engine control device for a vehicle in which a valve means in an engine intake passage is operatively associated with an accelerator pedal such that the opening degree of the valve means is changed by operation of the accelerator pedal so as to control at least one of the amount .of intake air and the amount of fuel supplied to an engine, the engine control device comprising:

an accelerator pedal sensor for sensing the amount of operation of the accelerator pedal imparted by a driver of the vehicle;

a load condition sensor for sensing the load condition of the engine;

an engine rotation sensor for sensing the number of revolutions per minute of the engine;

an actuator operatively connected with the valve means for operating the valve means so as to adjust the opening degree thereof; and a control unit associated with the accelerator pedal sensor, the load condition sensor, the engine rotation sensor and the actuator for controlling the operation of the actuator in such a manner that, when the accelerator pedal is operated to rapidly increase the opening degree of the valve means, the valve means is gradually moved to be at a prescribed degree of opening which is set based on at least one of the sensed amount of accelerator pedal operation, the sensed engine load condition, and the sensed number of revolutions per minute of the engine.

The above and other objects, features and advantages of the present invention will become apparent from the following detailed description of a preferred embodiment thereof when considered in conjuction with the accompanying drawings.

DESCRIPTION OF THE PREFERRED EMBODIMENTS

The present invention will now be described in detail with reference to a preferred embodiment thereof as illustrated in the accompanying drawings.

Figure 3:
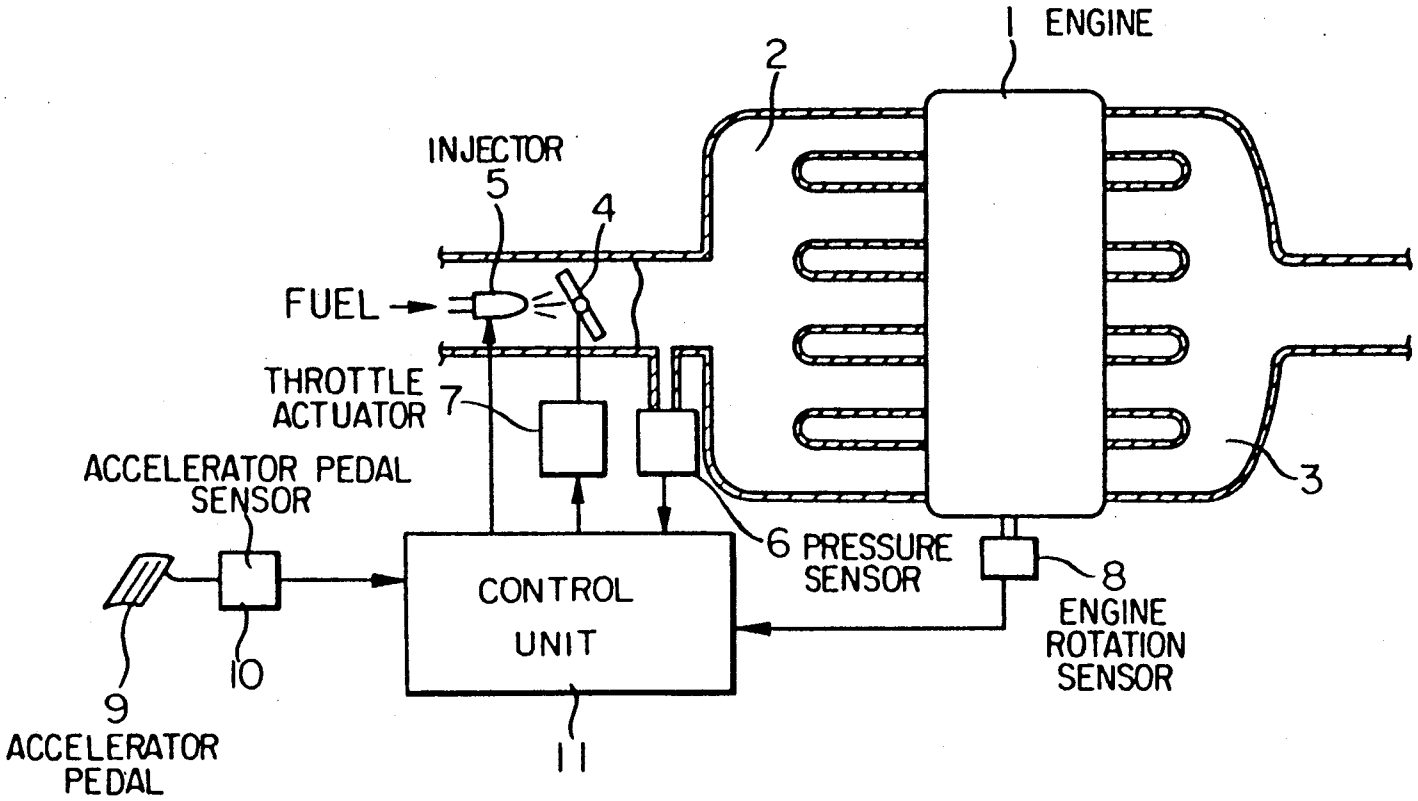
FIG. 3 is a schematic view showing the general arrangement of an engine control device for a vehicle in accordance with the present invention.

Referring first to FIG. 3, there is shown the general arrangement of an engine control device for a vehicle in accordance with the present invention. The engine control device as illustrated comprises an engine 1, an intake passage or manifold 2 connected with the engine 1 for supplying an air/fuel mixture to the engine 1, an exhaust passage or manifold 3 connected with the engine 1 for discharging exhaust gas from the engine 1 to the ambient atmosphere, a valve means 4 in the form of a throttle valve disposed in the intake manifold 2 for controlling the amount of intake air or air/fuel mixture sucked into the engine 1, an injector 5 in the intake manifold 2 for injecting fuel fed from an unillustrated fuel source into the intake manifold 2, a load condition sensor 6 in the form of a pressure sensor for sensing the pressure in the intake manifold 2, a throttle actuator 7 for opening and closing the throttle valve 4, an engine rotation sensor 8 for sensing the number of revolutions per minute of the engine, an accelerator pedal 9 for operation by the driver of the vehicle for adjusting the opening degree of the throttle valve 4, an accelerator pedal sensor 10 for sensing the amount of operation of the accelerator pedal 9 imparted by the driver of the vehicle, and a control unit 11 to which output signals from the accelerator pedal sensor 10, the pressure sensor 6 and the engine rotation sensor 8 are input for controlling the operation of the fuel injector 5 and the throttle actuator 7. The control unit 11 comprises a microprocessor, a random access memory, a read only memory and the like, and performs calculations based on the various input signals from the sensors in accordance with prescribed procedures or programs stored in the read only memory so as to control the fuel injector 5, the throttle actuator 7 and the like.

Figure 1:
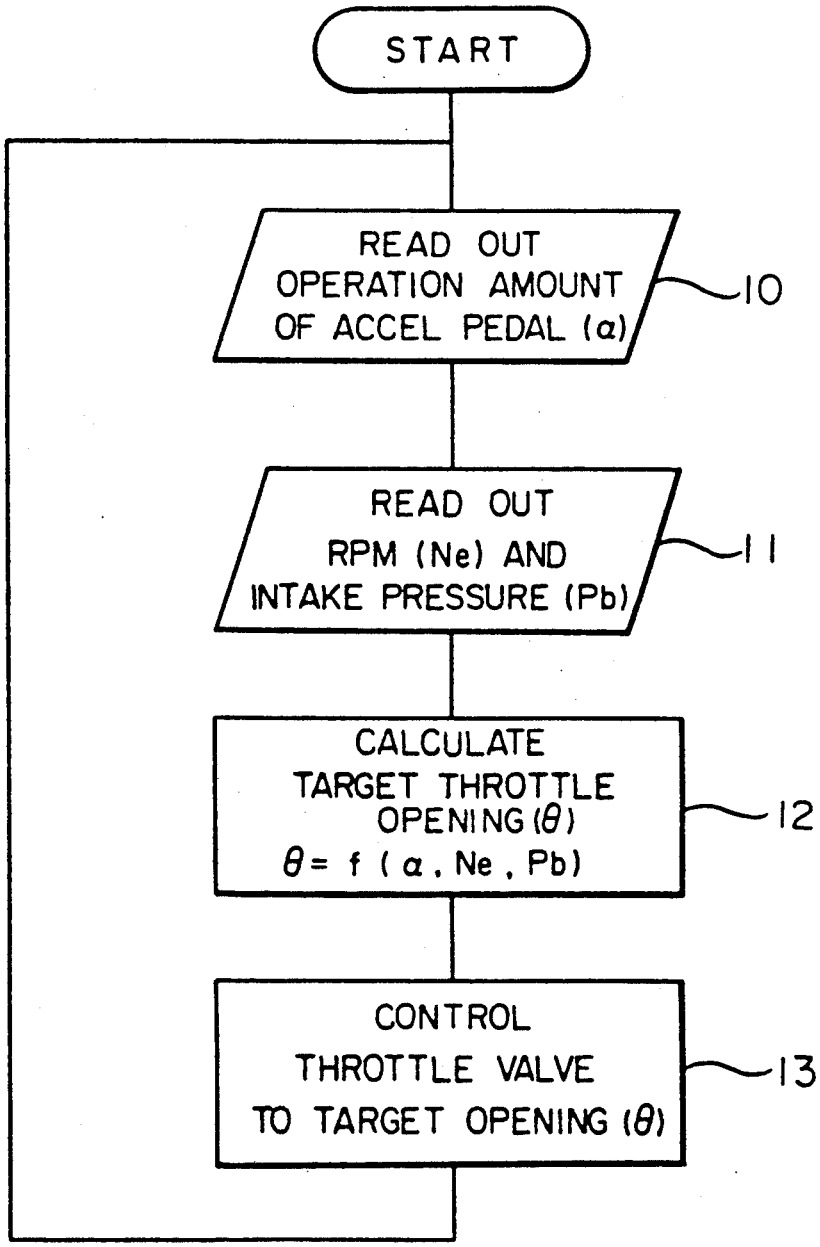
FIG. 1 PRIOR ART
FIG. 1 is a flow chart showing the operating process of a conventional engine control device for a vehicle.
Figure 2:
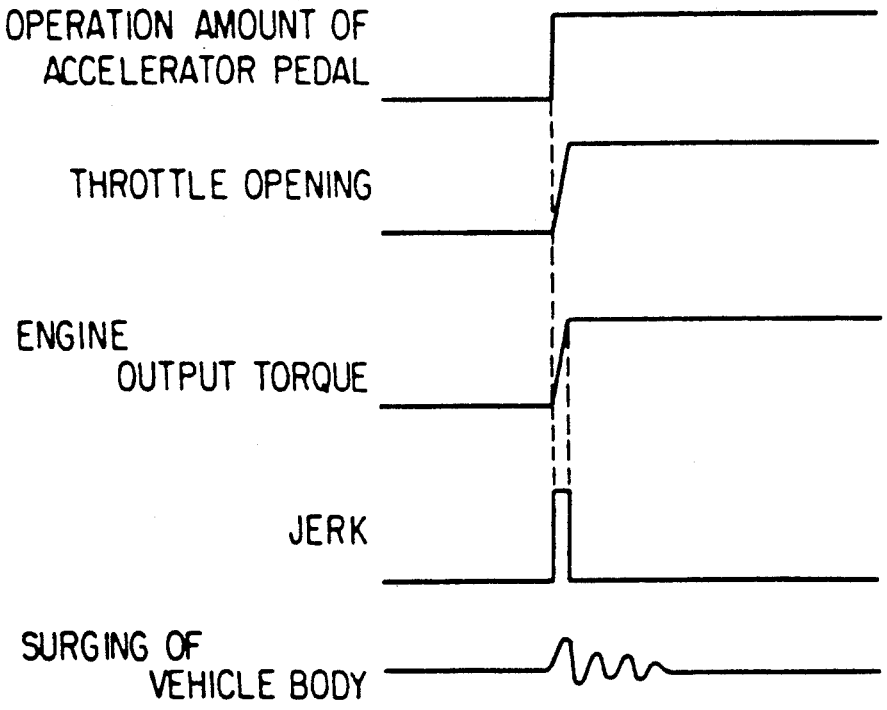
FIG. 2 PRIOR ART
FIG. 2 is a timing chart showing the time-related operations of various factors controlled by the conventional engine control device.
Figure 4:
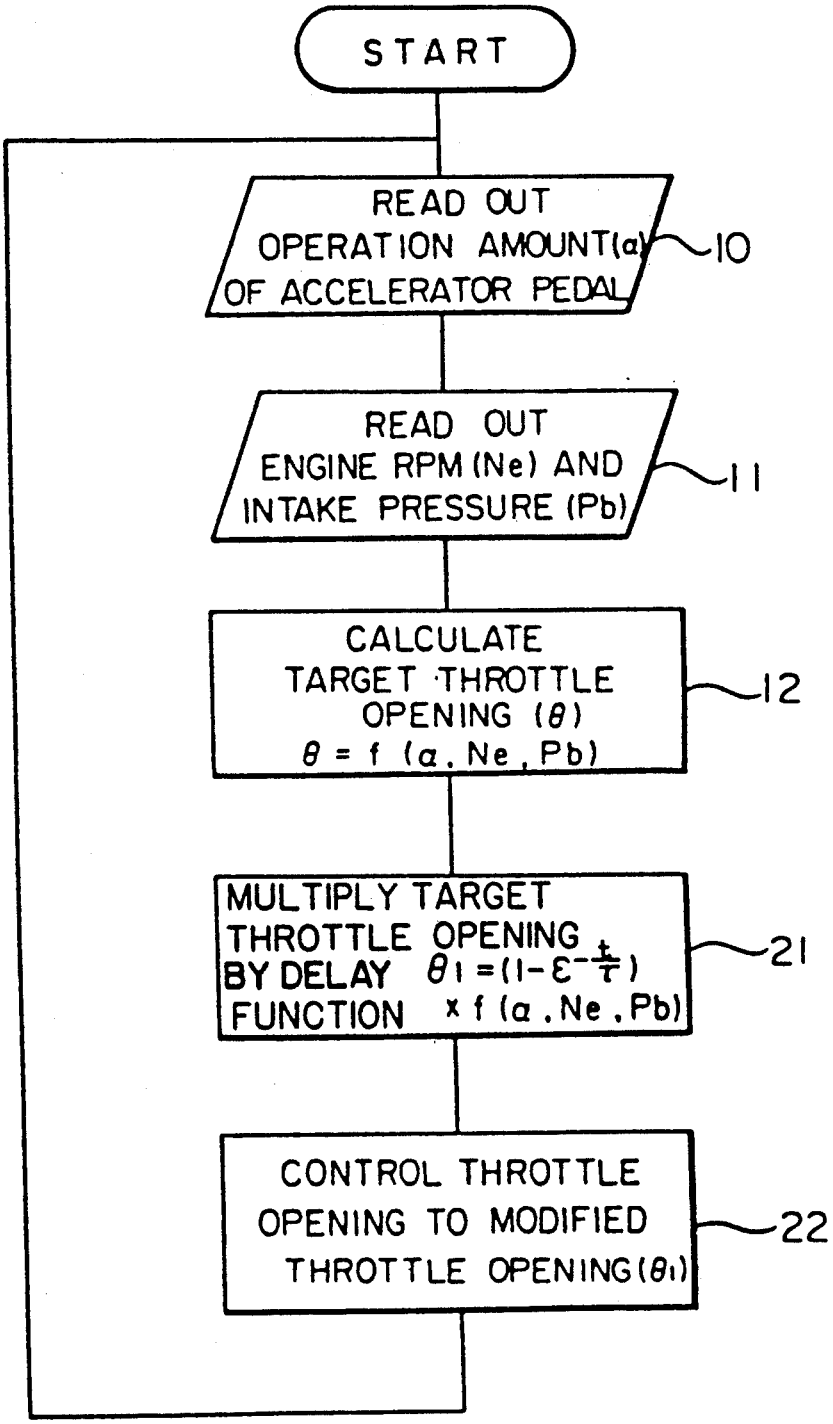
FIG. 4 is a flow chart showing the operating process of the engine control device in accordance with the present invention.

Description will now be made of the operation of the above-described engine control device of the invention with particular reference to FIGS. 4 and 5. Referring first to FIG. 4, Steps 10 through 12 are the same as those in FIG. 1. In Step 21, a target opening degree $\theta$ of the throttle valve 4, which is calculated in Step 12 based on at least one of the sensed amount of operation of the accelerator pedal 9, the sensed RPM of the engine and the sensed intake pressure, as previously described in detail with reference to FIG. 1, is multiplied bY a first-order delay function which is expressed as $$(1 - \epsilon^{-\frac{t}{\tau}})$$

to obtain $\theta_1$. In the delay function, t is time, and $\tau$ is a first-order delay time constant which is set to be an optimal value based on the engine characteristics, suspension characteristics and the like of a specific type of vehicle. For example, such a time constant is generally set to be 0.1–0.5 seconds.

Subsequently in Step 22, the throttle actuator 7 is controlled so that the throttle valve 4 is moved to the target opening degree 8. Thereafter, the control process returns to Step 10.

Figure 5:
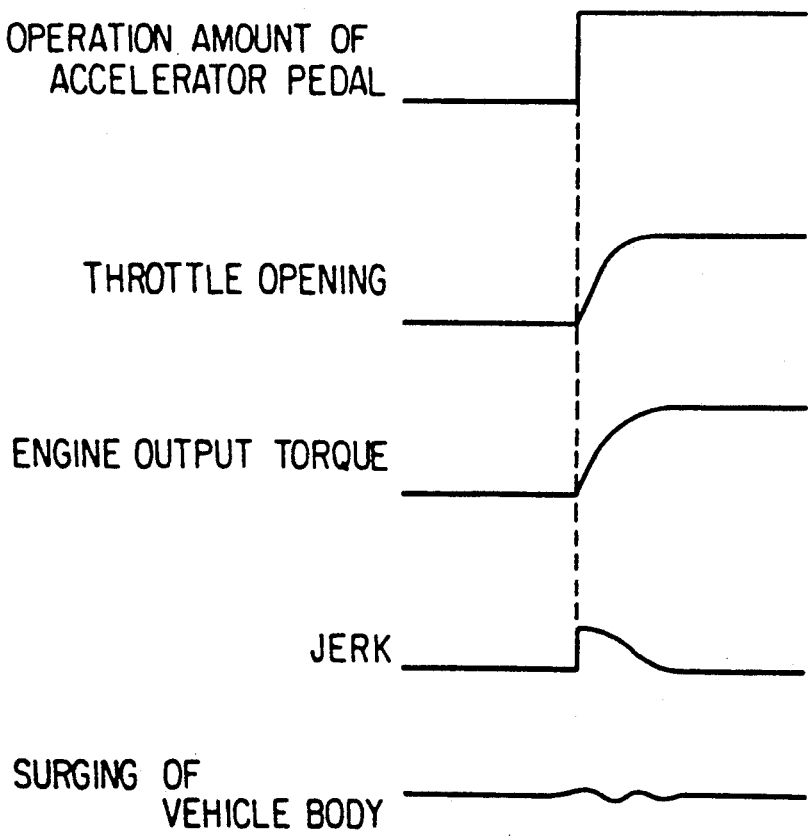
FIG. 5 is a timing chart showing the time-related operations of various factors controlled by the engine control device of the present invention.

Controlling the engine in the above manner provides a very smooth or gradual change in the opening degree of the throttle valve 4 in spite of a sharp change or increase in the accelerator pedal operation, as clearly illustrated in FIG. 5. Therefore the output torque of the engine, which corresponds to the vehicle acceleration, changes in a smooth or gradual manner and hence a jerk, which would otherwise be caused by abrupt depression of the accelerator pedal 9, will be substantially suppressed or minimized. As a result, vibratory forces transmitted from the engine 1 through engine mounts to the vehicle body are greatly reduced so that fore-and-aft vibrations or surging of the vehicle can be effectively alleviated or suppressed, thereby eliminating discomfort or an uneasy feel in the ride of the operator and passengers.

In the above-described embodiment, the first-order delay factor is introduced in the course of converting the accelerator pedal operation $\alpha$ into a throttle opening $\theta_1$, but instead it is also possible to achieve the same effects by controlling the opening degree of the throttle valve 4 based on a value which is calculated by multiplying a target value of intake pressure, which is preset based on the amount of operation of the accelerator pedal 9, by the first-order delay function. Further, the delay factor is not necessarily limited to a first-order delay function but may be a substantially linear delay function which, for example, changes linearly at a predetermined gradient. In this case, substantially the same effects will be obtained. In addition, if the time constant $\tau$ is arbitrarily changed according to the operator's choice or suspension characteristics, riding comfort will be further improved.

Although in the above-described embodiment, the valve means 4 comprises a throttle valve which adjusts the amount of an air/fuel mixture supplied to the engine, it may be a valve for adjusting the amount of intake air or the amount of fuel supplied to the engine.

As described above, the present invention provides a novel engine control method and device for controlling the operation of a vehicular engine with a valve for adjusting the amount of intake air and/or the amount of fuel supplied to the engine, in which the opening degree of the valve, which is predetermined in relation to at least one parameter such as accelerator pedal operation, engine load, engine RPM and the like, is gradually or gently varied particularly when the accelerator pedal is abruptly operated or depressed in low load range of the engine operation. As a consequence, even if the operator abruptly depresses the accelerator pedal, a rise or increase in the output torque of the engine is moderated so as to substantially suppress not only vibratory forces which are transmitted from the engine to the vehicle body through the engine mounts but also vibrations in the suspension system. This provides remarkable improvements in riding comfort for the driver and passengers of the vehicle.

We claim:

1. An engine control method for a vehicle in which a valve means in an engine intake passage is operatively associated with an accelerator pedal such that the opening degree of said valve means is changed by operation of said accelerator pedal so as to control at least one of the amount of intake air and the amount of fuel supplied to an engine, the method comprising the steps of:

sensing the amount of operation of said accelerator pedal imparted by an operator;

sensing the load condition of an engine;

sensing the number of revolutions per minute of said engine; and gradually opening said valve means according to a non step-wise function when said accelerator pedal is operated rapidly to open said valve means to a target degree of opening which is set based on at least one of the sensed amount of accelerator pedal operation, the sensed engine load condition, and the sensed number of revolutions per minute of said engine.

2. An engine control method for a vehicle as claimed in claim 1 wherein said valve means comprises a prescribed non step-wise mathematical function.

3. An engine control method for a vehicle as claimed in claim 2 wherein said function comprises the product of said target opening degree of said valve means and $$(1 - \epsilon^{-\frac{t}{\tau}}),$$

where t is the time and $\tau$ is a time constant.

4. An engine control method for a vehicle as claimed in claim 3 wherein said time constant is selected by said operator.

5. An engine control method for a vehicle as claimed in claim 3 wherein said time constant is based on the suspension characteristics of said vehicle.

6. An engine control method for a vehicle as claimed in claim 3 wherein said time constant is 0.1–0.5 seconds.

7. An engine control method for a vehicle as claimed in claim 2 wherein said function comprises the product of a target intake pressure based on the sensed amount of accelerator pedal operation and $$(1 - \epsilon^{-\frac{t}{\tau}}),$$

where t is time and $\tau$ is a time constant.

8. An engine control method for a vehicle as claimed in claim 7 wherein said time constant is selected by said operator.

9. An engine control method for a vehicle as claimed in claim 7 wherein said time constant is determined based on the suspension characteristics of said vehicle.

10. An engine control method for a vehicle as claimed in claim 7 wherein said time constant is 0.1–0.5 seconds.

11. An engine control device for a vehicle in which the degree of opening of a valve means in an engine intake passage is changed by operation of an accelerator pedal to control at least one of the amount of intake air and the amount of fuel supplied to an engine, the engine control device comprising:

an accelerator pedal sensor for sensing the amount of operation of said accelerator pedal imparted by an operator;

a load condition sensor for sensing the load condition of said engine;

an engine rotation sensor for sensing the number of revolutions per minute of said engine;

an actuator operatively connected with said valve means for operating said valve means so as to adjust the opening degree thereof; and means including a control unit associated with said accelerator pedal sensor, said load condition sensor, said engine rotation sensor and said actuator for controlling the operation of said actuator when said accelerator pedal is operated rapidly to open said valve means gradually according to a non step-wise function to a prescribed degree of opening which is set based on at least one of the sensed amount of accelerator pedal operation, the sensed engine load condition, and the sensed number of revolutions per minute of said engine.

12. An engine control device for a vehicle as claimed in claim 11 wherein said function comprises a prescribed non step-wise mathematical function.

13. An engine control device for a vehicle as claimed in claim 12 wherein said function comprises the product of said target opening degree of said valve means and $$(1 - \epsilon^{-\frac{t}{\tau}}),$$

where t is time and $\tau$ is a time constant.

14. An engine control device for a vehicle as claimed in claim 13 wherein said time constant is selected by said operator.

15. An engine control device for a vehicle as claimed in claim 13 wherein said time constant is based on the suspension characteristics of said vehicle.

16. An engine control device for a vehicle as claimed in claim 13 wherein said time constant is 0.1–0.5 seconds.

17. An engine control device for a vehicle as claimed in claim 12 wherein said function comprises the product of a target intake pressure based on the sensed amount of accelerator pedal operation and $(1-\epsilon^{-t/\tau})$, where t is time and $\tau$ is a time constant.

18. An engine control device for a vehicle as claimed in claim 17 wherein said time constant is selected by said operator.

19. A engine control device for a vehicle as claimed in claim 17 wherein said time constant is based on the suspension characteristics of said vehicle.

20. An engine control device for a vehicle as claimed in claim 17 wherein said time constant is 0.1–0.5 seconds.

21. An engine control device for a vehicle as claimed in claim 11 wherein said valve means comprises a throttle valve.

22. An engine control device for a vehicle as claimed in claim 11 wherein said load condition sensor comprises a pressure sensor for sensing the pressure in said intake passage.

23. An engine control apparatus for an engine of a vehicle comprising:

a variable-opening valve for controlling an air/fuel mixture for an engine;

an actuator for controlling the opening of the valve;

a depression sensor for sensing the depression of an accelerator pedal of the vehicle;

target calculating means for calculating a target opening $\Theta$ for the valve as a function of the depression sensed by the depression sensor; and actuator control means for controlling the actuator to open the valve to the target opening $\Theta$ according to the function $\Theta_1 = \Theta \cdot (1-\epsilon^{-t/\tau})$, wherein $\Theta_1$ is the valve opening at time t, and $\tau$ is a time constant.

* * * * *